US010395580B2

(12) United States Patent
Hwang

(10) Patent No.: US 10,395,580 B2
(45) Date of Patent: Aug. 27, 2019

(54) METHOD OF COMPENSATING FOR LUMINANCE OF A DISPLAY PANEL

(71) Applicant: Samsung Display Co., Ltd., Yongin-si, Gyeonggi-do (KR)

(72) Inventor: Jun-Ho Hwang, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/702,380

(22) Filed: Sep. 12, 2017

(65) Prior Publication Data

US 2018/0130394 A1 May 10, 2018

(30) Foreign Application Priority Data

Nov. 4, 2016 (KR) ..... 10-2016-0146871

(51) Int. Cl.

| | |
|---|---|
| ***G09G 3/20*** | (2006.01) |
| ***G09G 3/3233*** | (2016.01) |
| ***G09G 3/3291*** | (2016.01) |
| *G09G 3/3208* | (2016.01) |

(52) U.S. Cl.

CPC ..... *G09G 3/2003* (2013.01); *G09G 3/3233* (2013.01); *G09G 3/3291* (2013.01); *G09G 3/3208* (2013.01); *G09G 2310/027* (2013.01); *G09G 2320/043* (2013.01); *G09G 2320/0673* (2013.01)

(58) Field of Classification Search

CPC ... G09G 2320/0233; G09G 2320/0271; G09G 2320/0276; G09G 2320/029; G09G 2320/0295; G09G 2320/043; G09G 2320/045; G09G 2320/048; G09G 2320/0673; G09G 2320/0693; G09G 3/2003; G09G 3/3208; G09G 3/3233; G09G 3/3225; G09G 3/3291; G09G 2360/145; G09G 2360/147; G09G 2360/148; G09G 2310/027

See application file for complete search history.

(56) References Cited

U.S. PATENT DOCUMENTS

| | | | | |
|---|---|---|---|---|
| 7,227,519 | B1 * | 6/2007 | Kawase | G09G 3/2081 345/77 |
| 2003/0067546 | A1 * | 4/2003 | Asano | G09G 5/00 348/226.1 |
| 2005/0110420 | A1 * | 5/2005 | Arnold | G09G 3/3225 315/169.3 |

(Continued)

FOREIGN PATENT DOCUMENTS

| | | | |
|---|---|---|---|
| KR | 10-2011-0023141 | A | 3/2011 |
| KR | 10-2013-0058496 | A | 6/2013 |
| KR | 10-2015-0114065 | A | 10/2015 |

*Primary Examiner* — Tom V Sheng

(74) *Attorney, Agent, or Firm* — Lewis Roca Rothgerber Christie LLP

(57) ABSTRACT

A method of compensating luminance of a display panel, the method including respectively measuring, at different time points, test luminances of the display panel driven by test data while a multi-time programming (MTP) operation for setting the luminance of the display panel respectively for one or more gray values is performed, and deriving a luminance equation representing a relationship between a driving time of the display panel and the luminance of the display panel from the time points and the test luminances.

19 Claims, 11 Drawing Sheets

(56) References Cited

U.S. PATENT DOCUMENTS

| | | | | |
|---|---|---|---|---|
| 2006/0077135 | A1* | 4/2006 | Cok | G09G 3/3216 345/76 |
| 2006/0267889 | A1* | 11/2006 | Kimura | G09G 3/2022 345/84 |
| 2007/0002073 | A1* | 1/2007 | Baik | G09G 3/3233 345/589 |
| 2013/0120659 | A1* | 5/2013 | Park | G06T 5/001 348/674 |
| 2015/0287350 | A1* | 10/2015 | Jun | G09G 3/006 345/690 |
| 2017/0116931 | A1* | 4/2017 | Matsui | G09G 3/006 |

* cited by examiner

FIG. 2C

| SP_OFFSET | | |
|---|---|---|
| CR0 | CG0 | CB0 |
| CR1 | CG1 | CB1 |
| CR2 | CG2 | CB2 |
| CR3 | CG3 | CB3 |
| CR4 | CG4 | CB4 |
| CR5 | CG5 | CB5 |
| CR6 | CG6 | CB6 |
| CR7 | CG7 | CB7 |
| CR8 | CG8 | CB8 |
| CR9 | CG9 | CB9 |
| CRT | CGT | CBT |

| CR9/CG9/CB9 FOR OFFSET | |
|---|---|
| SET VALUE | OFFSET |
| 1_1111_1111 | -255 |
| 1_1111_1110 | -254 |
| 1_1111_1101 | -253 |
| . . . | . . . |
| 1_0000_0010 | -2 |
| 1_0000_0001 | -1 |
| 1_0000_0000 | 0 |
| 0_1111_1111 | +255 |
| 0_1111_1110 | +254 |
| | |
| 0_0000_0010 | +2 |
| 0_0000_0001 | +1 |
| 0_0000_0000 | 0 |

| CRT/CGT/CBT FOR OFFSET | |
|---|---|
| SET VALUE | OFFSET |
| 1111 | +15 |
| 1110 | +14 |
| 1101 | +13 |
| . . . | . . . |
| 0010 | +2 |
| 0001 | +1 |
| 0000 | 0 |

| CRn/CGn/CBn FOR OFFSET | |
|---|---|
| OTP VALUE | OFFSET |
| 1111_1111 | -127 |
| 1111_1110 | -126 |
| 1111_1101 | -125 |
| . . . | . . . |
| 1000_0010 | -2 |
| 1000_0001 | -1 |
| 1000_0000 | 0 |
| 0111_1110 | +126 |
| 0111_1101 | +125 |
| . . . | . . . |
| 0000_0010 | +2 |
| 0000_0001 | +1 |
| 0000_0000 | 0 |

METHOD OF COMPENSATING FOR LUMINANCE OF A DISPLAY PANEL

CROSS-REFERENCE TO RELATED APPLICATION

This application claims priority to, and the benefit of, Korean Patent Application No. 10-2016-0146871, filed on Nov. 4, 2016 in the Korean Intellectual Property Office (KIPO), the contents of which are incorporated herein in its entirety by reference.

BACKGROUND

1. Field

Embodiments of the present inventive concept relate to devices and methods for compensating luminance of display panels of display devices.

2. Description of the Related Art

A display device displays an image using pixels. Each pixel (e.g., an organic light emitting diode (OLED) pixel) may include a light emitting element and a driving circuit (or one or more transistors) for driving the light emitting element. The light emitting element and the driving circuit may degrade as a driving time of the display device increases. Thus, after the display device operates for a long time, the display device may display the image with luminance that is reduced in comparison with desired luminance.

To address this problem, the display device may compensate for the reduced luminance using a luminance characteristic curve representing a change of the luminance over time. The luminance characteristic curve can be derived by iteratively measuring the luminance of the display device for a long time. However, because the iterative measurement is performed only for a particular display device (e.g., a selected one or more of a plurality of display devices manufactured by the same manufacturing process), actual luminance characteristic curves of the respective display devices may be different from the luminance characteristic curve derived by the iterative measurement. Alternatively, when the iterative measurement is performed for each of the display devices to obtain its own luminance characteristic curve, manufacturing times of the respective display devices (or respective display panels) may be increased.

SUMMARY

Some embodiments provide a method of compensating luminance of a display panel.

According to embodiments, there is provided a method of compensating luminance of a display panel, the method including respectively measuring, at different time points, test luminances of the display panel driven by test data while a multi-time programming (MTP) operation for setting the luminance of the display panel respectively for one or more gray values is performed, and deriving a luminance equation representing a relationship between a driving time of the display panel and the luminance of the display panel from the time points and the test luminances.

The MTP operation may include sub-MTP operations, wherein an N-th sub-MTP operation of the sub-MTP operations generates an N-th gamma voltage based on reference gamma voltages, generates N-th gray data having an N-th gray value among the gray values used in the display panel, provides the N-th gray data to the display panel, measures an N-th actual luminance of the display panel driven by the N-th gray data, and adjusts the reference gamma voltages based on the N-th actual luminance and an N-th reference luminance that is set for the N-th gray value of the gray values, and wherein the reference gamma voltages respectively correspond to representative gray values among the gray values used in the display panel.

The test data may have a maximum one of the gray values used in the display panel.

Respectively measuring, at the different time points, the test luminances of the display panel may include measuring a first test luminance of the display panel driven by the test data at a first time point, measuring a second test luminance of the display panel driven by the test data at a second time point that is later than the first time point by a first time interval, and measuring a third test luminance of the display panel driven by the test data at a third time point that is later than the second time point by a second time interval.

The first time interval and the second time interval may have a same time length.

The first time point may be a time point at which the MTP operation starts, and the third time point may be a time point at which the MTP operation ends.

The MTP operation may include a first sub-MTP operation for at least one of first gray values that is less than or equal to a maximum gray value, and greater than or equal to a middle gray value, the first sub-MTP operation being performed during the first time interval between the first time point and the second time point, and a second sub-MTP operation for at least one of second gray values that is less than the middle gray value, and greater than or equal to a minimum gray value, the second sub-MTP operation being performed during the second time interval between the second time point and the third time point.

Measuring the first test luminance may include generating a test voltage corresponding to the test data based on reference gamma voltages, providing the test voltage to the display panel, and measuring the first test luminance of the display panel corresponding to the test voltage.

The luminance equation may be a cubic equation derived from the first test luminance at the first time point, the second test luminance at the second time point, and the third test luminance at the third time point.

The luminance equation may be represented by $Y=\alpha*X^2+\beta*X+\gamma$, wherein Y represents the luminance of the display panel, X represents the driving time of the display panel, and $\alpha$, $\beta$ and $\gamma$ are constants.

The method may further include compensating for a luminance change of the display panel based on the luminance equation.

Compensating for the luminance change of the display panel may include calculating an actual driving time of the display panel, when the actual driving time exceeds a first driving time, calculating a first luminance change rate corresponding to the first driving time using the luminance equation, and compensating for the luminance change of the display panel based on the first luminance change rate.

The actual driving time may be calculated by accumulating input data provided to a display device including the display panel.

The first driving time may be longer than a time required for a module test process performed before a manufacturing process of a display device is completed.

Compensating for the luminance change of the display panel based on the first luminance change rate may include obtaining a first gamma offset corresponding to the first luminance change rate using a lookup table including a plurality of gamma offsets that are previously set for a plurality of luminance change rates, respectively, and adjusting reference gamma voltages based on the first gamma offset, wherein the first gamma offset includes adjustment values respectively for the reference gamma voltages, and wherein the reference gamma voltages correspond to representative gray values among the gray values used in the display panel, and are used to generate gamma voltages respectively corresponding to the gray values used in the display panel.

According to embodiments, there is provided a method of compensating luminance of a display panel, the method including measuring a first test luminance of the display panel driven by test data having a maximum gray value of gray values used in the display panel at a first time point, performing a first sub-multi-time programming (MTP) operation on at least one of first ones of the gray values that is less than or equal to the maximum gray value, measuring a second test luminance of the display panel driven by the test data at a second time point, performing a second sub-MTP operation on at least one of second ones of the gray values that is less than the first ones of the gray values, measuring a third test luminance of the display panel driven by the test data at a third time point, and deriving a luminance equation representing a relationship between a driving time of the display panel and the luminance of the display panel based on the first test luminance, the second test luminance, and the third test luminance.

The second time point may be later than the first time point by a first time interval, wherein the third time point is later than the second time point by a second time interval, and wherein the first time interval and the second time interval have a same time length.

The first time point may be a time point at which an MTP operation comprising the first and second sub-MTP operations starts, and the third time point may be a time point at which the MTP operation ends.

The method may further include compensating for a luminance change of the display panel based on the luminance equation.

Compensating for the luminance change of the display panel may include calculating a first luminance change rate corresponding to a first driving time of the display panel using the luminance equation, obtaining a first gamma offset corresponding to the first luminance change rate using a lookup table including a plurality of gamma offsets that are previously set for a plurality of luminance change rates, respectively, and adjusting reference gamma voltages based on the first gamma offset, wherein the first gamma offset includes adjustment values respectively for the reference gamma voltages, and wherein the reference gamma voltages correspond to representative gray values among the gray values used in the display panel, and the reference gamma voltages are used to generate gamma voltages respectively corresponding to the gray values used in the display panel.

As described above, the method of compensating the luminance of the display panel according to embodiments may measure the test luminances of the display panel driven by the test data at the different time points while the MTP operation including a process for measuring the luminance is performed. Thus, an additional dedicated luminance measurement equipment (or installation of the luminance measurement equipment) and allocation of additional dedicated time for measuring the test luminances are not required. Accordingly, the method of compensating the luminance of the display panel may prevent a manufacturing time of the display panel or the display device from increasing.

Further, the method of compensating the luminance of the display panel according to embodiments may derive the luminance equation that accords with an actual luminance characteristic of the display panel from the test luminances, and thus a luminance change (or a luminance drop) of the display panel may be accurately compensated.

BRIEF DESCRIPTION OF THE DRAWINGS

Illustrative, non-limiting embodiments will be more clearly understood from the following detailed description in conjunction with the accompanying drawings.

FIG. 2C is a diagram illustrating an example of a gamma offset generated by a data driving unit of FIG. 2B.

DETAILED DESCRIPTION

Figure 1:
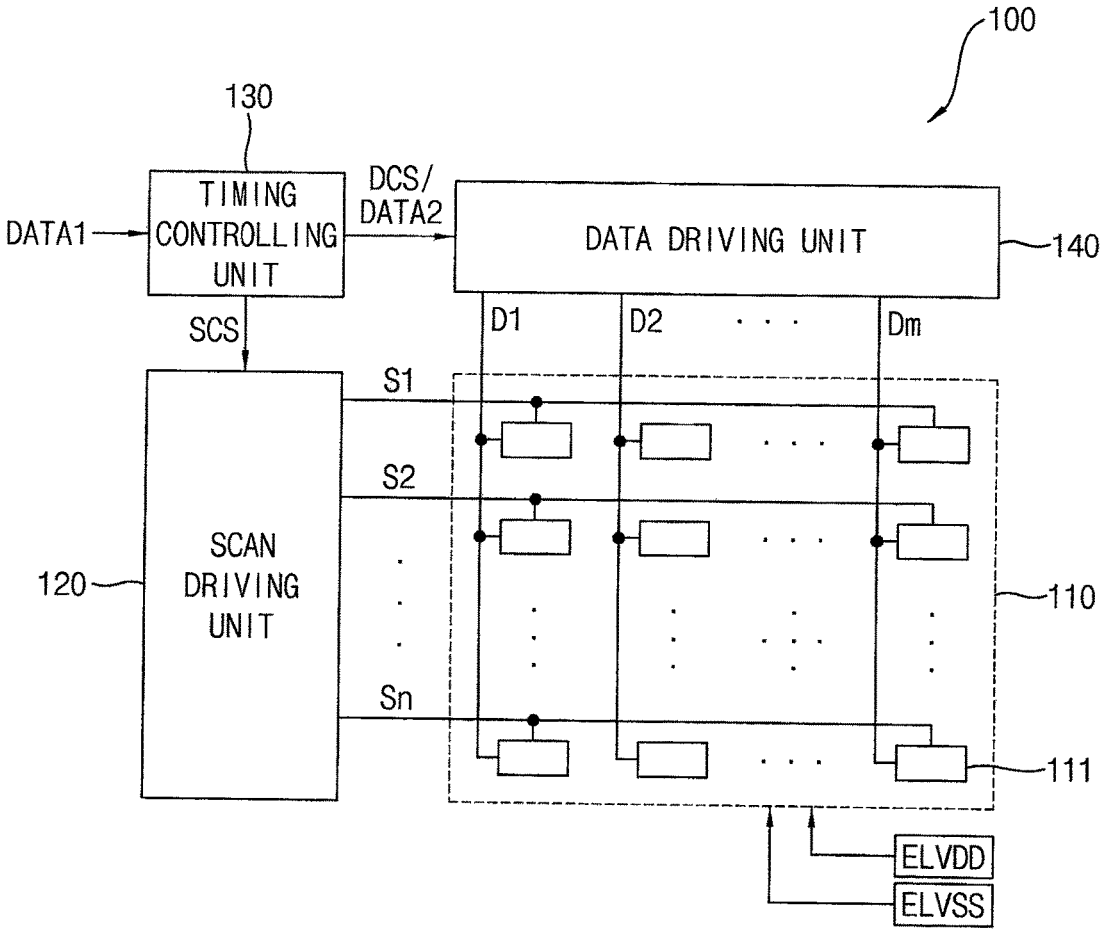
FIG. 1 is a block diagram illustrating a display device according to embodiments.

Features of the inventive concept and methods of accomplishing the same may be understood more readily by reference to the following detailed description of embodiments and the accompanying drawings. Hereinafter, embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

In the following description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. In addition, it will also be understood that when an element or layer is referred to as being "between" two elements or layers, it can be the only element or layer between the two elements or layers, or one or more intervening elements or layers may also be present.

For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

In the following examples, the x-axis, the y-axis and the z-axis are not limited to three axes of a rectangular coordinate system, and may be interpreted in a broader sense. For example, the x-axis, the y-axis, and the z-axis may be perpendicular to one another, or may represent different directions that are not perpendicular to one another.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

Also, any numerical range disclosed and/or recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. § 112(a) and 35 U.S.C. § 132(a).

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, embodiments of the present inventive concept will be explained in detail with reference to the accompanying drawings.

A method of compensating luminance of a display panel according to embodiments may measure the luminance of the display panel at multiple time points while a multi-time programming (MTP) operation is performed, and may derive a luminance characteristic (e.g., a luminance equation, a luminance characteristic function, or a luminance characteristic curve) from the measured luminance. Hereinafter, the display panel for which the method is performed, a display device (and/or a test system including a luminance measurement device) that performs the method, and the MTP operation (or an MTP process) related in time to the method will be described before describing the method according to embodiments.

Figure 2A:
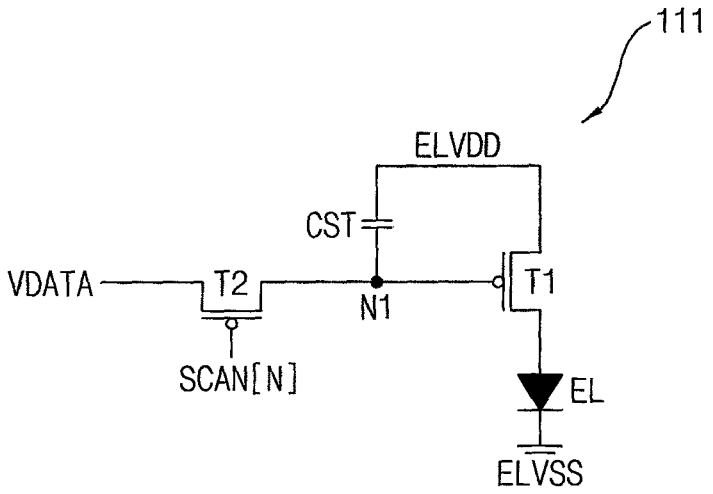
FIG. 2A is a circuit diagram illustrating an example of a pixel included in a display device of FIG. 1.
Figure 2B:
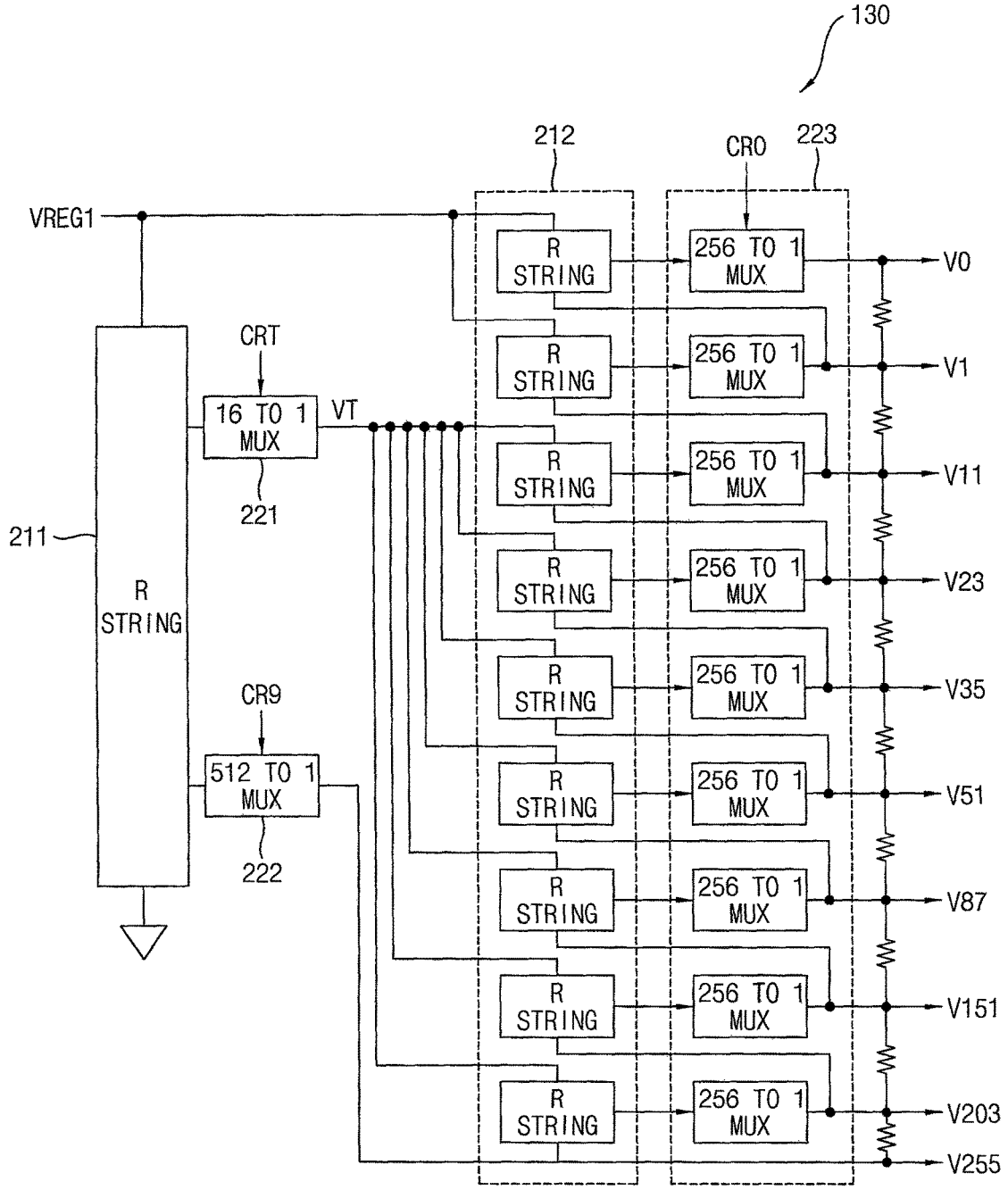
FIG. 2B is a diagram illustrating an example of a data driving unit included in a display device of FIG. 1.

FIG. 1 is a block diagram illustrating a display device according to embodiments, FIG. 2A is a circuit diagram illustrating an example of a pixel included in a display device of FIG. 1, FIG. 2B is a diagram illustrating an example of a data driving unit included in a display device of FIG. 1, and FIG. 2C is a diagram illustrating an example of a gamma offset generated by a data driving unit of FIG. 2B.

Referring to FIG. 1, a display device 100 may include a display panel 110, a scan driving unit 120, a timing controlling unit 130, and a data driving unit 140.

The display device 100 may display an image based on input data (e.g., first data DATA1) provided from an external device. For example, the display device 100 may be an organic light emitting diode (OLED) display device.

The display panel 110 may include n scan lines S1 through Sn, m data lines D1 through Dm, and a plurality of pixels 111 respectively arranged at crossing regions of the scan lines S1 through Sn and the data lines D1 through Dm, where each of n and m is an integer greater than 1. Each pixel 111 may store data signals provided through the data lines D1 through Dm in response to scan signals provided through the scan lines S1 through Sn, and may emit light based on the stored data signals.

Referring to FIG. 2A, each pixel 111 may include a light emitting element EL, a first transistor T1, a second transistor T2, and a storage capacitor CST.

The light emitting element EL may be coupled between a first power supply voltage ELVDD and a second power supply voltage ELVSS, and may emit light based on a driving current flowing from the first power supply voltage ELVDD to the second power supply voltage ELVSS. For example, the light emitting element EL may be the OLED. In some embodiments, the first power supply voltage ELVDD and the second power supply voltage ELVSS may be generated by a power supply unit included in the display device 100, and the first power supply voltage ELVDD may be higher than the second power supply voltage ELVSS.

The first transistor T1 may control the driving current (or an amount of the driving current) in response to a first node voltage at a first node N1. The second transistor T2 may transfer a data signal VDATA to the first node N1 in response to a scan signal SCAN[N]. The storage capacitor CST may be coupled between the first power supply voltage ELVDD and the first node N1, and may store the data signal VDATA transferred through the second transistor T2.

The first transistors T1 of the plurality of pixels 111 included in the display panel may have slightly different characteristics (e.g., driving or V-I characteristics) due to a process variation or the like. Thus, the pixels 111 included in the display panel may have different characteristics (e.g., different light-emission characteristics) from each other. The different characteristics of the pixels 111 may be adjusted to be uniform by performing a test process (e.g., an MTP operation, which will be described below with reference to FIG. 3).

Although FIG. 2A illustrates an example of the pixel 111 including two (P-type) transistors T1 and T2 and one capacitor CST, a structure of the pixel 111 is not limited thereto. For example, the pixel 111 may have a 7T1C pixel structure (i.e., a structure including seven transistors and one capacitor). Further, in some embodiments, the pixel 111 may include one or more N-type transistors.

Referring again to FIG. 1, the scan driving unit 120 may generate the scan signals based on a scan driving control signal SCS. The scan driving control signal SCS may include a start pulse and clock signals, and the scan driving unit 120 may include a shift register that sequentially generates the scan signals in response to the start pulse and the clock signals.

The timing controlling unit 130 may control operations of the scan driving unit 120 and the data driving unit 140. The timing controlling unit 130 may generate the scan driving control signal SCS and a data driving control signal DCS to control the operations of the scan driving unit 120 and the data driving unit 140.

In some embodiments, the timing controlling unit 130 may calculate a driving amount of the pixels 111 (e.g., a degree to which the pixels 111 have been driven) based on the input data (e.g., the first data DATA1). Here, the driving amount of the pixels 111 may represent stress (or stress data) applied to the pixels 111, and may be proportional to gray values indicated by the input data and a driving time of the pixels 111. For example, the timing controlling unit 130 may generate an accumulated data value as the driving amount of the pixels 111 by accumulating at least one gray value included in the input data per frame. The driving amount (or the accumulated data value) of the pixels 111 may be used to determine a time point at which a luminance change of the display panel 110 is compensated.

The data driving unit 140 may generate the data signals based on second data DATA2 and gamma voltages, and may provide the data signals to the display panel 110 (or to the pixels 111). The data driving unit 140 may be controlled by the data driving control signal DCS to provide the data signals to the display panel 110.

Referring to FIGS. 2B and 2C, the data driving unit 140 may include first and second resistor strings 211 and 212, and first, second, and third selectors 221, 222, and 223, and may generate reference gamma voltages V0, V1, V11, V23, V35, V51, V87, V151, V203, and V255. The reference gamma voltages V0, V1, V11, V23, V35, V51, V87, V151, V203, and V255 may correspond to a gamma curve (representing a relationship between a gray value and a gamma voltage, e.g., a gamma curve of 2.2) at predetermined or representative gray values (e.g., 0, 1, 11, 23, 35, 51, 87, 151, 203, and 255).

The first resistor string 211 may divide a reference voltage VREG1. For example, the first resistor string 211 may include resistors connected in series between the reference voltage VREG1 and a ground voltage.

The first selector 221 may select one of output voltages from the first resistor string 211 as a bottom voltage VT based on a bottom control signal CRT. The first selector 221 may include a 16-to-1 multiplexer.

The second selector 222 may select one of the output voltages from the first resistor string 211 as a tenth reference gamma voltage V255 based on a tenth control signal CR9. The second selector 222 may include a 512-to-1 multiplexer.

The second resistor string 212 may include first through ninth sub-resistor strings, and the third selector 223 may include first through ninth sub-selectors. In some embodiments, the first through ninth sub-selectors may be 256-to-1 multiplexers.

With respect to a ninth reference gamma voltage V203, the ninth sub-resistor string may divide a voltage between the bottom voltage VT and the tenth reference gamma voltage V255, and the ninth sub-selector may output one of output voltages from the ninth sub-resistor string as the ninth reference gamma voltage V203.

Similarly, the eighth sub-resistor string may divide a voltage between the bottom voltage VT and the ninth reference gamma voltage V203, and the eighth sub-selector may output one of output voltages from the eighth sub-resistor string as the eighth reference gamma voltage V151.

Further, an i-th sub-resistor string (where i is an integer that is greater than 2) may divide a voltage between the bottom voltage VT and an (i+1)-th reference gamma voltage V151, V87, V51, V35, or V23, and an i-th sub-selector may output one of output voltages from the i-th sub-resistor string as an i-th reference gamma voltage V87, V51, V35, V23, or V11.

With respect to a second reference gamma voltage V1, the second sub-resistor string may divide a voltage between the reference voltage VREG1 and a third reference gamma voltage V11, and the second sub-selector may select one of output voltages from the second sub-resistor string as the second reference gamma voltage V1 in response to a second control signal.

Similarly, the first sub-resistor string may divide a voltage between the reference voltage VREG1 and the second reference gamma voltage V1, and the first sub-selector may select one of output voltages from the first sub-resistor string as a first reference gamma voltage V0 in response to a first control signal CR0.

Although it is not illustrated in FIG. 2B, the data driving unit 140 may generate gamma voltages by dividing the reference gamma voltages V0, V1, V11, V23, V35, V51, V87, V151, V203, and V255. The gamma voltages may respectively correspond to gray values.

Referring to FIG. 2C, a gamma register may store the first through tenth control signals CR0 through CR9 and the bottom control signal CRT (or set values thereof). In some embodiments, each pixel 111 of the display panel 110 may include first through third sub-pixels that respectively emit first through third color light (e.g., red light, green light, and blue light), and the gamma register may store a first set of the control signals CR0-CR9 and CRT for the first sub-pixel (e.g., a red sub-pixel), a second set of the control signals CG0-CG9 and CGT for the second sub-pixel (e.g., a green sub-pixel), and a third set of the control signals CB0-CB9 and CBT for the third sub-pixel (e.g., a blue sub-pixel) (or set values thereof).

As described above with reference to FIG. 2B, the second selector 222 that outputs the tenth reference gamma voltage V255 may be implemented as the 512-to-1 multiplexer, and, in this case, the tenth control signal CR9 (or CG9/CB9) may have a 9-bit set value.

Similarly, the first selector 221 that outputs the bottom voltage VT may be implemented as the 16-to-1 multiplexer, and, in this case, the bottom control signal CRT (or CGT/CBT) may have a 4-bit set value. The third selector 223 (or the sub-selectors) that outputs the first through ninth reference gamma voltages V0 through V203 may be implemented as the 256-to-1 multiplexer, and, in this case, each of the first through ninth control signals CRn (or CGn/CBn) (where n is an integer that is less than 9 and greater than −1) may have an 8-bit set value.

As described above with reference to FIGS. 2B and 2C, the data driving unit 140 may generate the reference gamma voltages V0, V1, V11, V23, V35, V51, V87, V151, V203, and V255 based on a gamma control signal (e.g., the first through tenth control signals CR0 through CR9 and the bottom control signal CRT), and the gamma register may store the gamma control signal (e.g., the first through tenth control signals CR0 through CR9 and the bottom control signal CRT (or set values thereof)).

Initial set values of the gamma control signal (e.g., the first through tenth control signals CR0 through CR9 and the bottom control signal CRT) may be obtained by performing an MTP operation during a manufacturing process for the display panel 110.

Figure 3:
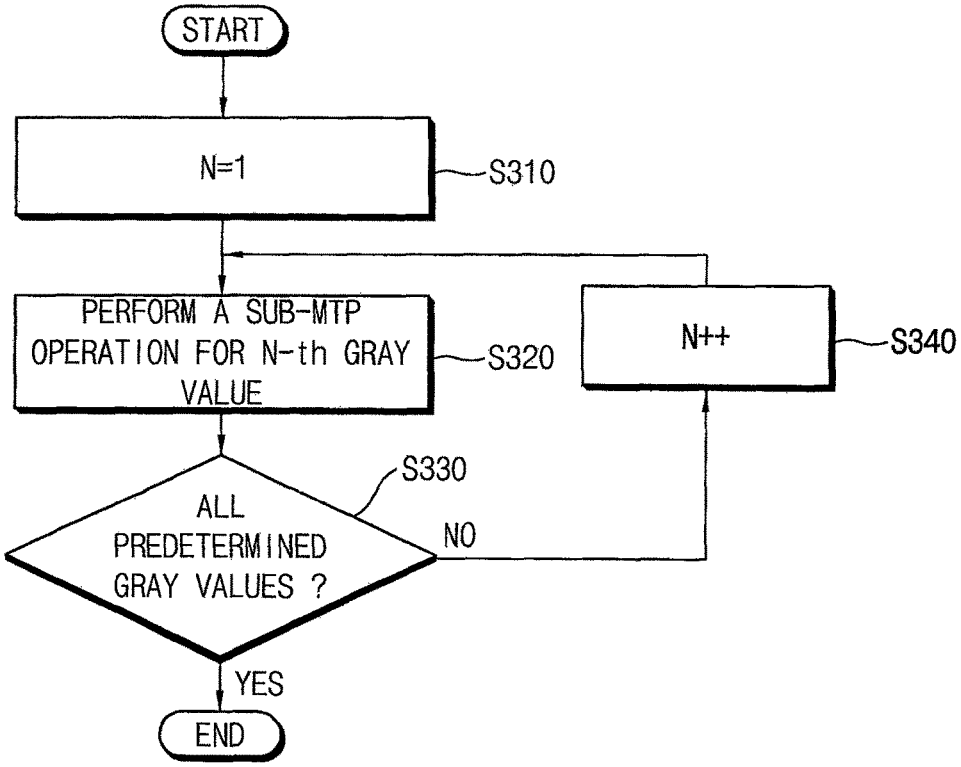
FIG. 3 is a flowchart illustrating an example of a multi-time programming (MTP) operation.
Figure 4A:
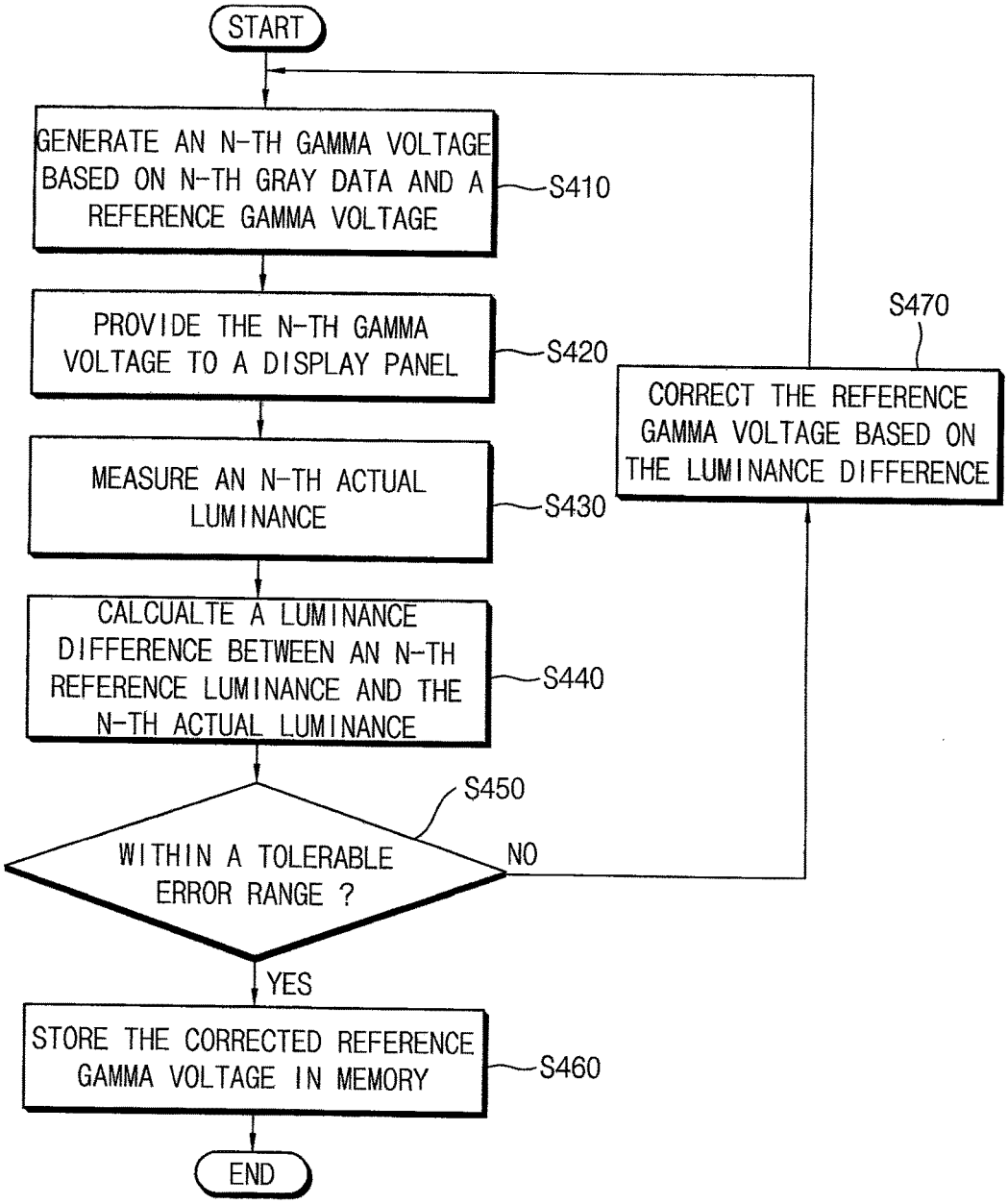
FIG. 4A is a flowchart illustrating an example of a sub-MTP operation included in an MTP operation of FIG. 3.
Figure 4B:
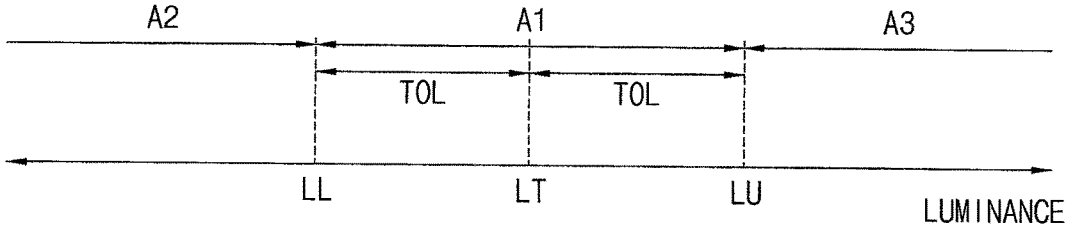
FIG. 4B is a diagram for describing a sub-MTP operation of FIG. 4A.

FIG. 3 is a flowchart illustrating an example of a multi-time programming (MTP) operation, FIG. 4A is a flowchart illustrating an example of a sub-MTP operation included in an MTP operation of FIG. 3, and FIG. 4B is a diagram for describing a sub-MTP operation of FIG. 4A.

Referring to FIG. 3, an MTP operation (or an MTP method) may include sub-MTP operations. Here, each sub-MTP operation may mean an MTP operation for a corresponding single one of gray values.

For example, in a case where 256 gray values (e.g., 0 through 255) are used in the display panel 110 (or in the display device 100), the MTP operation according to embodiments may include 256 sub-MTP operations for all of the 256 gray values. In another example, the MTP operation according to embodiments may include 10 sub-MTP operations for 10 representative gray values (e.g., the gray values corresponding to the first through tenth reference gamma voltages V0, V1, V11, V23, V35, V51, V87, V151, V203, and V255, or 0, 1, 11, 23, 35, 51, 87, 151, 203, and 255).

As illustrated in FIG. 3, the MTP method of FIG. 3 according to embodiments may perform a first sub-MTP operation for a first gray value (e.g., 255) (S310 and S320). For example, the first gray value may be one of the ten representative gray values, and the first sub-MTP operation may determine a set value of the tenth control signal CR9 for the tenth reference gray voltage V255 illustrated in FIG. 2B.

Subsequently, the MTP method of FIG. 3 may determine whether the sub-MTP operations for all predetermined (all or representative) gray values are performed (S330). If the sub-MTP operations for all predetermined gray values are not performed yet (S330: NO), the sub-MTP operation may be repeatedly performed in the order of a second gray value (e.g., 203), a third gray value (e.g., 151), etc. (S340 and S320). Thus, the MTP method of FIG. 3 may determine set values of the first through ninth control signals CR0 through CR9 for the first through ninth reference gray voltages V0, V1, V11, V23, V35, V51, V87, V151, and V203 illustrated in FIG. 2B.

As described above, the MTP method of FIG. 3 may repeatedly perform the sub-MTP operation from the maximum gray value (e.g., 255) to the minimum gray value (e.g., 0 or 1).

Referring to FIGS. 4A and 4B, a sub-MTP operation of FIG. 4A for an N-th gray value may generate an N-th gamma voltage based on N-th gray data having the N-th gray value and a reference gamma voltage (S410), may provide the N-th gamma voltage to the display panel 110 (S420), and may measure an N-th actual luminance of the display panel 110 driven by the N-th gamma voltage (S430). For example, the sub-MTP operation of FIG. 4A may measure the actual luminance of the display panel 110 by using a luminance measurement device.

The sub-MTP operation of FIG. 4A may calculate a luminance difference between an N-th reference luminance and the N-th actual luminance (S440). Here, the N-th reference luminance may be a target luminance corresponding to the N-th gray value at a predetermined gamma curve (e.g., a gamma curve of 2.2).

The sub-MTP operation of FIG. 4A may determine whether the luminance difference is within a tolerable error range of a gamma setting (or a gamma curve) of the display panel 110 (or the display device 100) (S450). Referring to FIG. 4B, a first luminance range A1 may correspond to the tolerable error range. The first luminance range A1 may include a target luminance LT, and may range from a lower limit LL to an upper limit LU. In some embodiments, the upper limit LU may be higher by a tolerable error TOL than the target luminance LT, and the lower limit LL may be lower by the tolerable error TOL than the target luminance LT. Thus, the sub-MTP operation of FIG. 4A may determine whether the actual luminance is within the first luminance range A1.

If the luminance difference is within the tolerable error range, the sub-MTP operation of FIG. 4A may store a corresponding (current or corrected) reference gamma voltage (e.g., a reference gamma voltage used to generate the N-th gamma voltage) or a set value of a control signal for the corresponding reference gamma voltage in a memory (S460). That is, if the actual luminance is within the first luminance range A1, the sub-MTP operation of FIG. 4A may decide that the display panel 110 normally operate in accordance with a predetermined or desired gamma curve, and may store the corresponding reference gamma voltage in the memory.

If the luminance difference falls outside the tolerable error range, the sub-MTP operation of FIG. 4A may correct the corresponding reference gamma voltage based on the luminance difference (S470). For example, if the N-th actual luminance is in a second luminance range A2 that is lower than the first luminance range A1, the sub-MTP operation of FIG. 4A may correct (e.g., increase) the corresponding reference gamma voltage (or the set value of the control signal for the corresponding reference gamma voltage) to increase the N-th actual luminance. If the N-th actual luminance is in a third luminance range A3 that is higher than the first luminance range A1, the sub-MTP operation of FIG. 4A may correct (e.g., decrease) the corresponding reference gamma voltage (or the set value of the control signal for the corresponding reference gamma voltage) to decrease the N-th actual luminance.

The sub-MTP operation of FIG. 4A may repeatedly perform the steps S410 through S450 and S470 until the luminance difference is within the tolerable error range. That is, the sub-MTP operation of FIG. 4A may re-measure the N-th actual luminance of the display panel 110 driven by the N-th gray data based on the corrected reference gamma voltage (S410, S420, and S430), may re-calculate the luminance difference between the N-th reference luminance and the N-th actual luminance (S440), and may determine whether the re-calculated luminance difference is within the tolerable error range (S450).

If the re-calculated luminance difference is within the tolerable error range (S450: YES), the corrected reference gamma voltage (or the corrected set value of the control signal for the corresponding reference gamma voltage) may be stored in the memory (S460).

As described above with reference to FIGS. 1 through 4B, the display panel 110 may display an image using pixels, which may have a non-uniform light emission characteristic due to a process variation, or the like. The display device 100 (and/or a test system including a luminance measurement device) may correct or set the reference gamma voltages used to generate gamma voltages (or data voltages) provided to the pixels by performing the MTP operation such that the pixels have the same or similar light emission characteristics.

Hereinafter, a method of compensating luminance of a display panel according to embodiments will be described below.

Figure 5:
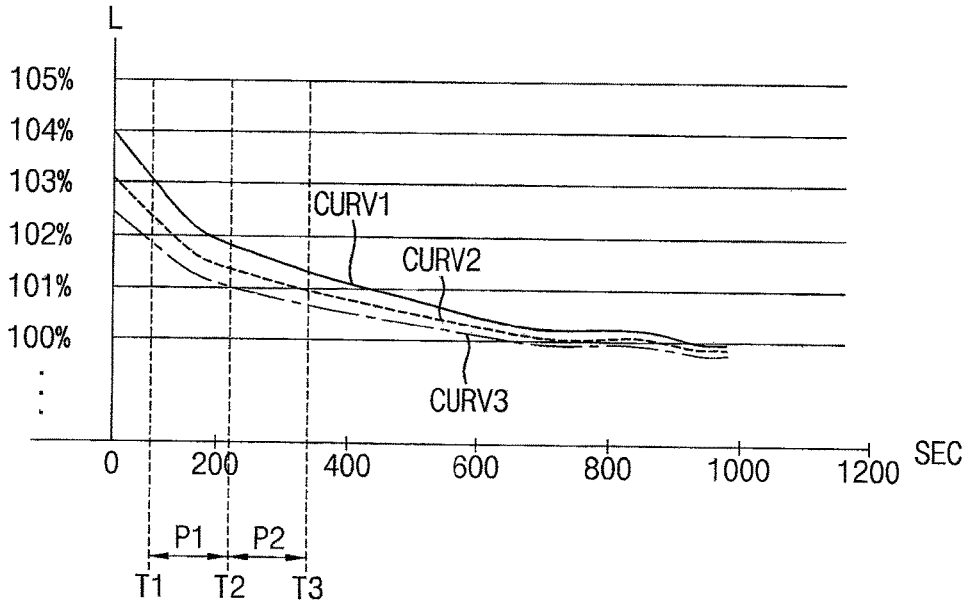
FIG. 5 is a graph illustrating a luminance change of a display panel.

FIG. 5 is a graph illustrating a luminance change of a display panel.

Referring to FIG. 5, a first luminance characteristic curve CURV1, a second luminance characteristic curve CURV2, and a third luminance characteristic curve CURV3 may represent luminance changes of display panels over time. As described above with reference to FIG. 2A, pixels may have different luminance characteristics, and, similarly, the display panels may have different luminance characteristics even if the display panels are manufactured by the same process.

Luminance of the display panels may be reduced over time (or as a driving time is increased). For example, at a time point when the driving time of 1,000 seconds for a first display panel elapses, the luminance of the first display panel may be dropped by about 4.5%, as compared with an initial luminance (e.g., luminance at a time point when the driving time is 0 seconds).

For reference, a first transistor T1 described above with reference to FIG. 2A may be degraded as the first transistor T1 operates. For example, a threshold voltage of the first transistor T1 may be shifted in a particular direction (or may be increased), and mobility of the first transistor T1 may be reduced. If the first transistor T1 is degraded, a driving current generated by the first transistor T1 may be reduced, and thus a pixel 111 may emit light with a luminance that is lower than a target luminance (e.g., a luminance before the first transistor T1 is degraded).

Further, a light emitting element EL also may be degraded as the light emitting element EL operates. For example, luminance of light generated by the light emitting element EL may be reduced even if the same driving current is provided to the light emitting element EL. Thus, the pixel 111 may emit light with luminance that is lower than the target luminance (e.g., the luminance before the light emitting element EL is degraded).

Luminance change (or reduction) rates of the display panels may be different from each other, such as the first luminance characteristic curve CURV1, the second luminance characteristic curve CURV2, and the third luminance characteristic curve CURV3 illustrated in FIG. 5. Thus, if the luminance drop is compensated based on a reference luminance characteristic curve (e.g., a luminance characteristic curve of a particular display panel selected as a sample), the luminance drop may not be accurately compensated with respect to at least a portion of the display devices.

A method of compensating luminance of a display panel according to embodiments may measure a plurality of luminances of a target display panel, and may derive a luminance characteristic curve (or an actual luminance characteristic) of the target display panel based on the measured luminances. In particular, the method of compensating the luminance of the display panel may measure the plurality of luminances ata plurality of times points (e.g., first through third times points T1, T2, and T3 illustrated in FIG. 5) having a predetermined time interval while an MTP operation including a process for measuring the luminance is performed. Accordingly, an additional time dedicated to deriving the luminance characteristic curve (or the measurement of the luminance) of the target display panel is not required, and thus the luminance drop of the target display panel may be accurately compensated using the luminance characteristic curve while preventing a manufacturing time for the target display panel from being increased.

Figure 6:
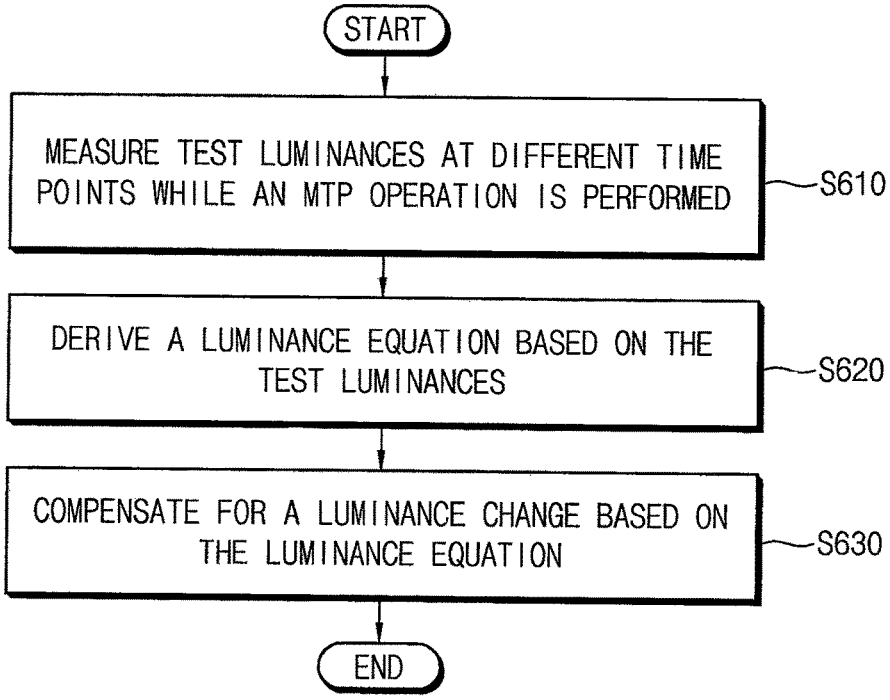
FIG. 6 is a flowchart illustrating a method of compensating luminance of a display panel according to embodiments.
Figure 7:
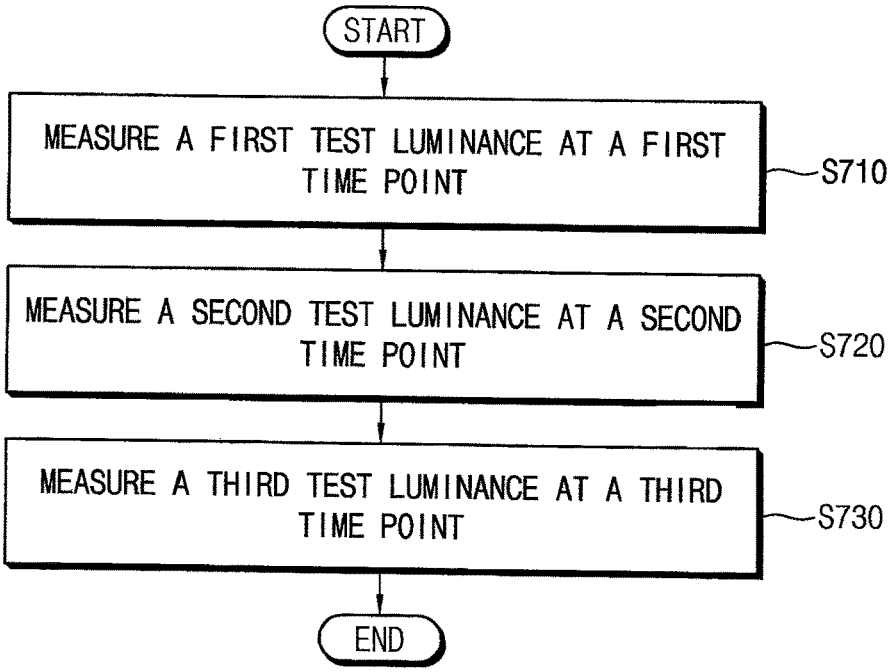
FIG. 7 is a flowchart illustrating an example of a process of measuring test luminances in a luminance compensation method of FIG. 6.
Figure 8:
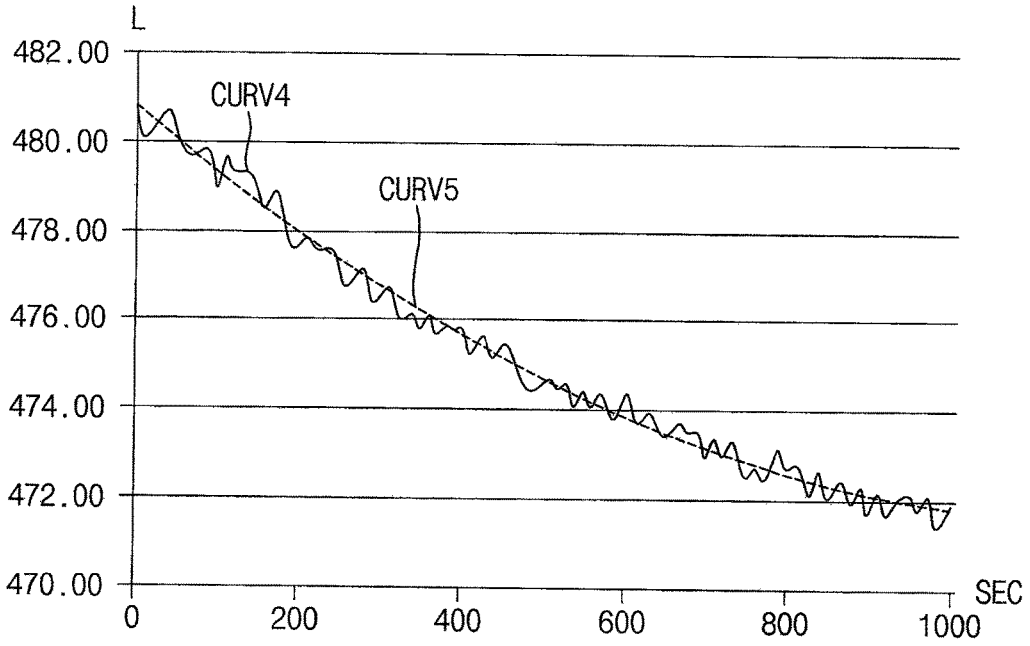
FIG. 8 is a graph illustrating an example of a luminance characteristic curve obtained by a luminance compensation method of FIG. 6.

FIG. 6 is a flowchart illustrating a method of compensating luminance of a display panel according to embodiments, FIG. 7 is a flowchart illustrating an example of a process of measuring test luminances in a luminance compensation method of FIG. 6, and FIG. 8 is a graph illustrating an example of a luminance characteristic curve obtained by a luminance compensation method of FIG. 6.

Referring to FIGS. 1 and 6, a method of compensating luminance of a display panel illustrated in FIG. 6 may be performed by a display device 100 of FIG. 1 (or a test system including a luminance measurement device and the display device 100).

The method of FIG. 6 may measure a plurality of test luminances of a display panel 110 driven by test data at a plurality of different time points while an MTP operation is performed (S610). As described above with reference to FIG. 3, the MTP operation may determine a reference gamma voltage (or a set value of a control signal for the reference gamma voltage) such that the luminance of the display panel becomes the same as a reference luminance (or a target luminance). In some embodiments, the test data may have the maximum gray value among gray values used in the display panel 110 (or a display device 100). For example, the test data may have a gray value of 255 among the gray values ranging from 0 to 255. That is, the test data may be a full-white pattern such that the display panel 110 displays a full-white image.

For example, the method of FIG. 6 may measure the test luminances of the display panel 110 driven by the full-white pattern at two or more different time points while the MTP operation is performed.

Referring to FIGS. 5 and 7, the method of FIG. 6 may measure a first test luminance of the display panel 110 driven by the test data at a first time point T1 (S710), may measure a second test luminance of the display panel 110 driven by the test data at a second time point T2 (S720), and may measure a third test luminance of the display panel 110 driven by the test data at a third time point T3 (S730).

As illustrated in FIG. 5, the second time point T2 may be later than the first time point T1 by a first time interval (or a first time period P1), and the third time point T3 may be later than the second time point T2 by a second time interval (or a second time period P2).

In some embodiments, the first time point T1 may be a time point at which the MTP operation starts, and the third time point T3 may be a time point at which the MTP operation ends. Thus, the method of FIG. 6 may measure the first test luminance by providing the test data to the display panel 110 (or the display device 100) at the time point at which the MTP operation starts, may measure the second test luminance by providing the test data to the display panel 110 at a time point when a portion (e.g., half) of the MTP operation has progressed, and may measure the third test luminance by providing the test data to the display panel 110 at the time point at which the MTP operation ends.

In some embodiments, the MTP operation may include a first sub-MTP operation for at least one of first gray values performed during the first time period P1, and a second sub-MTP operation for at least one of second gray values performed during the second time period P2. Here, as illustrated in FIG. 5, the first time period P1 may be between the first time point T1 and the second time point T2, and the second time period P2 may be between the second time point T2 and the third time point T3. The first gray values may be less than or equal to the maximum gray value, and may be greater than or equal to a middle gray value. For example, the first gray values may range from a gray value of 51 corresponding to a sixth reference gamma voltage V51 to a gray value of 255 corresponding to a tenth reference gamma voltage V255 described above with reference to FIG. 2B. Similarly, the second gray values may be less than the middle gray value, and may be greater than or equal to the minimum gray value. For example, the second gray values may range from a gray value of 0 corresponding to a first reference gamma voltage V0 to a gray value less than 51 corresponding to the sixth reference gamma voltage V51 described above with reference to FIG. 2B.

For example, the MTP operation (or the sub-MTP operations) may be repeatedly performed with respect to representative gray values in the order from the maximum gray value to the minimum gray value. The method of FIG. 5 may measure the first test luminance immediately before or immediately after the first time point T1 when the maximum reference gamma voltage (e.g., the tenth reference gamma voltage V255) corresponding to the maximum gray value is set, may measure the second test luminance immediately before or immediately after the second time point T2 when a middle reference gamma voltage (e.g., the sixth reference gamma voltage V51) corresponding to the middle gray value is set, and may measure the third test luminance immediately before or immediately after the third time point T3 when the minimum reference gamma voltage (e.g., the first reference gamma voltage V0) corresponding to the minimum gray value is set.

Generally, to measure test luminances at particular time points having a time interval, a dedicated luminance measurement equipment and a measurement time corresponding to the time interval (e.g., a time corresponding to a sum of the first time period P1 and the second time period P2) are used. However, the method of FIG. 6 according to embodiments may measure the test luminances while the MTP operation is performed, and thus an additional dedicated luminance measurement equipment (or installation of the luminance measurement equipment) and allocation of additional dedicated time for measuring the test luminances may be omitted by the method of FIG. 6.

In some embodiments, the method of FIG. 6 may measure the first through third test luminances through the steps S410 through S430 described above with reference to FIG. 4A. For example, the method of FIG. 6 may generate a test voltage corresponding to the test data based on reference gamma voltages, may provide the test voltage to the display panel 110, and may measure the first test luminance (or the second/third test luminance) of the display panel 110 corresponding to the test voltage.

Referring again to FIG. 6, the method of FIG. 6 may derive a luminance equation (or a luminance characteristic curve, for example a first luminance characteristic curve CURV1 illustrated in FIG. 5) that represents a relationship between a driving time of the display panel 110 and the luminance of the display panel 110 from the time points (e.g., the first through third time points T1, T2, and T3 illustrated in FIG. 5) and the test luminances (S510). That is, the method of FIG. 6 may obtain the luminance equation based on the first test luminance at the first time point T1, the second test luminance at the second time point T2, and the third test luminance at the third time point T3. In some embodiments, the luminance equation is a cubic equation.

For example, the luminance equation may be expressed as the following [Equation 1].

$$Y=\alpha*X^2+\beta*X+\gamma \quad \text{[Equation 1]}$$

where Y represents the luminance of the display panel 110, X represents the driving time of the display panel 110, and α, β and γ are constants.

Referring to FIG. 8, a fourth luminance characteristic curve CURV4 represents luminance of the display panel 110 that is continuously measured at the regular interval of 10 seconds while the display panel 110 is driven by the test data (or the full-white pattern), and a fifth luminance characteristic curve CURV5 may correspond to the luminance equation obtained based on the test luminances of the display panel 110 measured at the first through third time points T1 through T3.

As illustrated in FIG. 8, the fifth luminance characteristic curve CURV5 (or the luminance equation) may be substantially the same as the fourth luminance characteristic curve CURV4 (or the actual luminance characteristic curve).

Although it is described that the method of FIG. 6 measures the test luminances at the first through third time points T1 through T3, the method of FIG. 6 is not limited thereto. For example, the method of FIG. 6 may measure the test luminances at two time points, or may measure the test luminances at four or more time points, while the MTP operation is performed. If the test luminances are measured at the four or more time points, the fifth luminance characteristic curve CURV5 (or the luminance equation) may be more similar to the fourth luminance characteristic curve CURV4 (or the actual luminance characteristic curve).

Referring again to FIG. 6, the method of FIG. 6 may compensate for the luminance change based on the luminance equation (S630).

Figure 9:
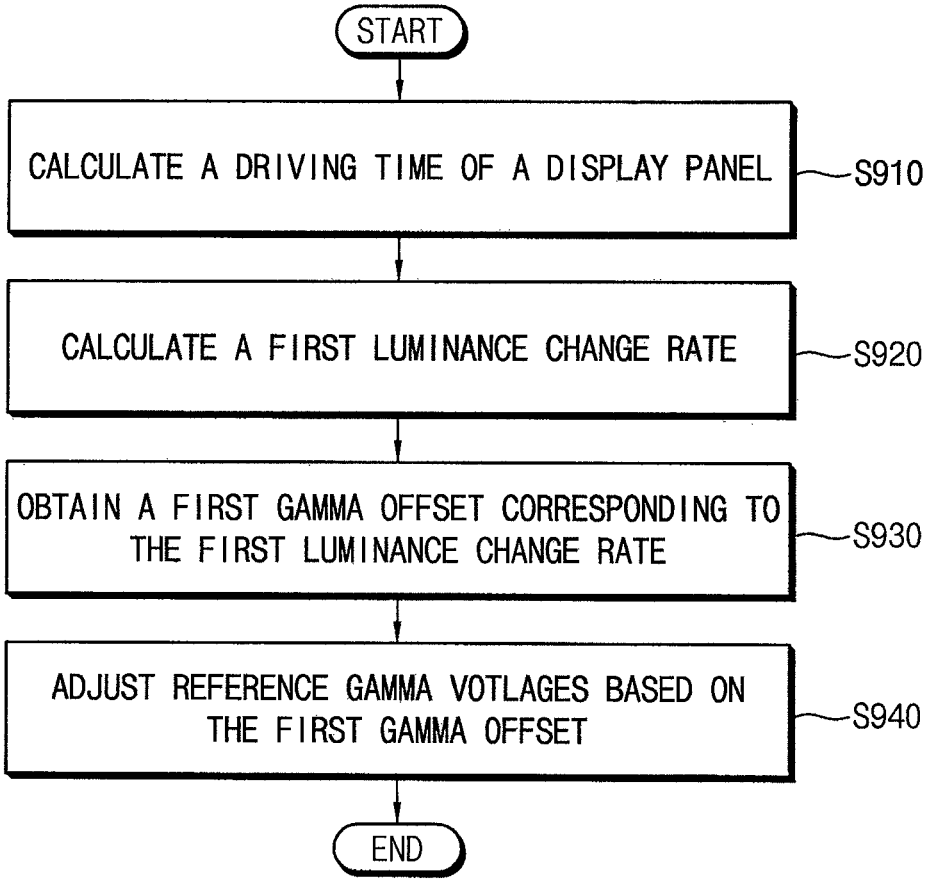
FIG. 9 is a flowchart illustrating an example of a process of compensating for a luminance change of a display panel in a luminance compensation method of FIG. 6.

FIG. 9 is a flowchart illustrating an example of a process of compensating for a luminance change of a display panel in a luminance compensation method of FIG. 6.

Referring to FIG. 9, a method of FIG. 9 may calculate an actual driving time of the display panel 110 (S910). If the actual driving time exceeds a first driving time, the method of FIG. 9 may calculate a first luminance change rate corresponding to the first driving time based on the luminance equation (S920). The method of FIG. 9 may compensate for a luminance change (or a luminance drop) of the display panel 110 based on the first luminance change rate (S930 and S940).

Here, the actual driving time may be calculated by accumulating input data (e.g., first data DATA1 illustrated in FIG. 1) provided to the display device 100. The actual driving time may correspond to stress applied to pixels as described above with reference to FIG. 1. The first driving time may be longer than a time required for test processes performed before a manufacturing process of the display device 100 is completed. For example, the first driving time may be about 1,000 seconds.

That is, the test processes (e.g., a module test process, an aging process, etc.) for the display panel 110 may be performed based on the reference gamma voltages that are set by the MTP operation. However, after the first driving time (in some embodiments, after a time point at which a normal operation of the display device 100 is initiated, or at a time point at which the manufacturing process of the display device 100 is completed), the luminance drop (e.g., a luminance drop caused while the display panel 110 operates during the test processes) may be compensated using the luminance equation. Thus, the display device 100 may display an accurate image with target luminance.

In some embodiments, the method of FIG. 9 may obtain a first gamma offset corresponding to the first luminance change rate using a lookup table (S930), and may adjust the reference gamma voltages based on the first gamma offset to compensate for the luminance change (S940). The reference gamma voltages may be the first through tenth reference gamma voltages V0 through V255 described above with reference to FIG. 2B, and may be used to generate gamma voltages (or data voltages) corresponding to the gray values at the data driving unit 140. The lookup table may include gamma offsets (e.g., gamma offsets illustrated in FIG. 2C) that are previously set for a plurality of luminance change rates, respectively. The first gamma offset may include a plurality of adjustment values (e.g., offsets or set values of control signals illustrated in FIG. 2C) for adjusting a plurality of the reference gamma voltages, respectively.

As described above with reference to FIGS. 6 through 9, the method of compensating the luminance of the display panel 110 according to embodiments may measure the test luminances of the display panel 110 driven by the test data at the different time points while the MTP operation is performed, and may derive the luminance equation representing the luminance characteristic of the display panel 110 based on the test luminances. In particular, because the method measures the test luminances during performance of the MTP operation, an additional dedicated luminance measurement equipment (or installation of the luminance measurement equipment) and allocation of additional dedicated time for measuring the test luminances are not required, thereby preventing a manufacturing time of the display panel 110 from being increased.

Further, because the luminance equation of the display panel 110 derived from the test luminances of the display panel 110 accords with the actual luminance characteristic of the display panel 110, the method may accurately compensate for the luminance change (or the luminance drop) of the display panel 110.

Figure 10:
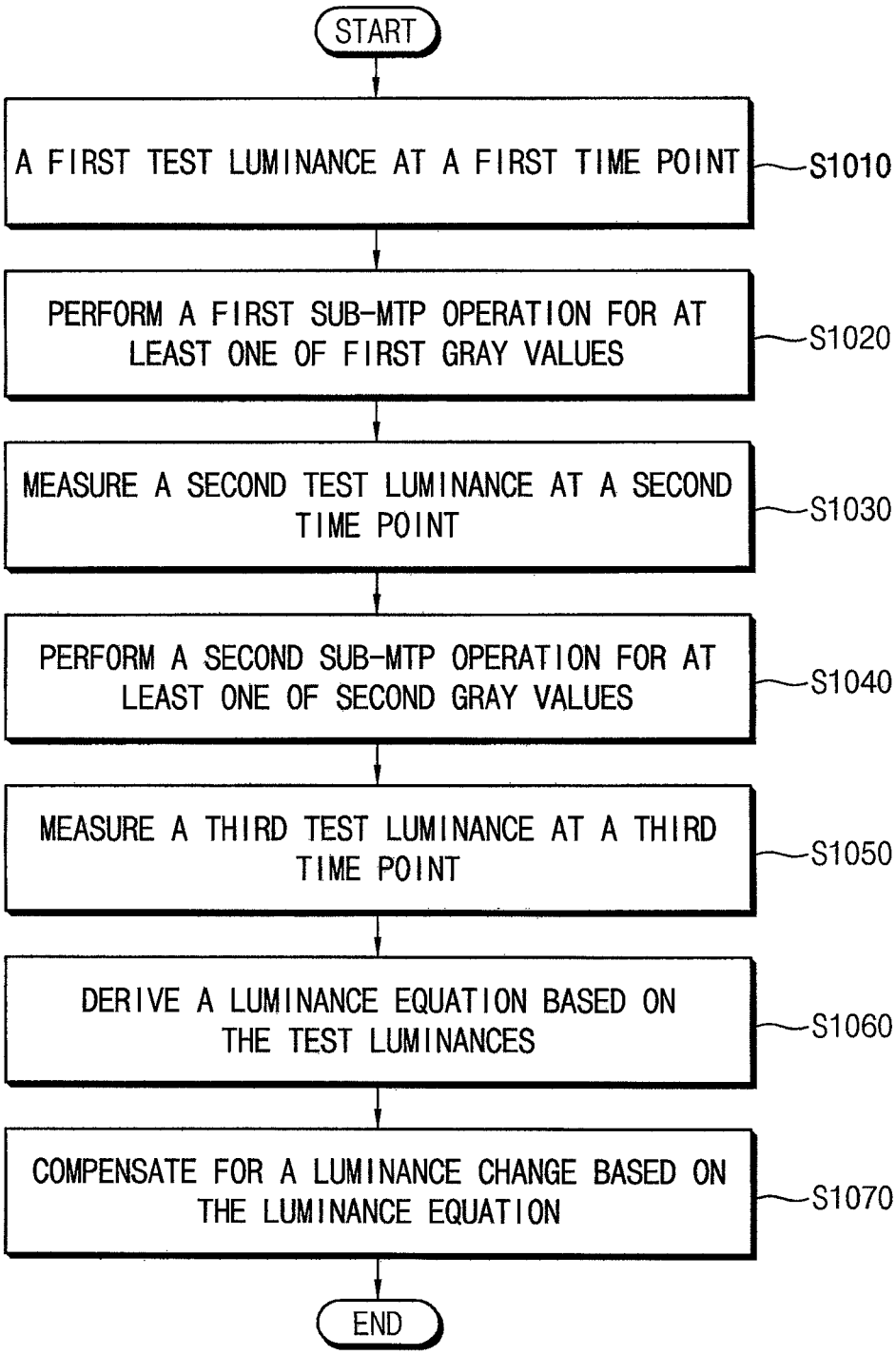
FIG. 10 is a flowchart illustrating a method of compensating luminance of a display panel according to embodiments.

FIG. 10 is a flowchart illustrating a method of compensating luminance of a display panel according to embodiments.

Referring to FIGS. 1, 5, and 10, a method of FIG. 10 may be performed may be performed by a display device 100 of FIG. 1 (or a test system including a luminance measurement device and the display device 100).

The method of FIG. 10 may measure a first test luminance of a display panel 110 driven by test data at a first time point T1 (S1010). In some embodiments, the test data may have the maximum gray value among gray values used in the display panel 110 (or the display device 100). For example, the test data may be a full-white pattern. As described above with respect to FIG. 7, the method of FIG. 10 may generate a test voltage corresponding to the test data based on reference gamma voltages, may provide the test voltage to the display panel 110, and may measure the first test luminance of the display panel 110 corresponding to the test voltage.

The method of FIG. 10 may perform a first sub-MTP operation for at least one of first gray values (S1020). As described above with reference to FIG. 6, the first gray values may be less than or equal to the maximum gray value and may be greater than or equal to a middle gray value. For example, the first gray values may range from a gray value of 51 corresponding to a sixth reference gamma voltage V51 to a gray value of 255 corresponding to a tenth reference gamma voltage V255 described above with reference to FIG. 2B.

The method of FIG. 10 may measure a second test luminance of the display panel 110 driven by the test data at a second time point T2 (S1030).

The method of FIG. 10 may perform a second sub-MTP operation for at least one of second gray values (S1040). As described above with reference to FIG. 6, the second gray values may be less than the middle gray value, and may be greater than or equal to the minimum gray value. For example, the second gray values may range from a gray value of 0 corresponding to a first reference gamma voltage V0 to a gray value less than 51 corresponding to the sixth reference gamma voltage V51 described above with reference to FIG. 2B.

The method of FIG. 10 may measure a third test luminance of the display panel 110 driven by the test data at a third time point T3 (S1050).

As described above with reference to FIG. 6, the method of FIG. 10 may repeatedly perform the sub-MTP operations for representative gray values in the order from the maximum gray value to the minimum gray value, may measure the first test luminance immediately before or immediately after the first time point T1 when the maximum reference gamma voltage (e.g., the tenth reference gamma voltage V255) corresponding to the maximum gray value is set, may measure the second test luminance immediately before or immediately after the second time point T2 when a middle reference gamma voltage (e.g., the sixth reference gamma voltage V51) corresponding to the middle gray value is set, and may measure the third test luminance immediately before or immediately after the third time point T3 when the minimum reference gamma voltage (e.g., the first reference gamma voltage V0) corresponding to the minimum gray value is set.

The method of FIG. 10 may derive a luminance equation based on the first test luminance at the first time point T1, the second test luminance at the second time point T2, and the third test luminance at the third time point T3 (S1060). Here, the luminance equation may represent a luminance change of the display panel according to time (or a driving time) elapsed.

The method of FIG. 10 may compensate for the luminance change of the display panel 110 based on the luminance equation (S1070).

As described above with reference to FIG. 9, the method of FIG. 10 may obtain a first gamma offset corresponding to a first luminance change rate using a lookup table (S930), and may adjust reference gamma voltages based on the first gamma offset to compensate for the luminance change. The reference gamma voltages may be the first through tenth reference gamma voltages V0 through V255 described above with reference to FIG. 2B, and may be used to generate gamma voltages (or data voltages) corresponding to the gray values at the data driving unit 140. The lookup table may include gamma offsets (e.g., gamma offsets illustrated in FIG. 2C) that are previously set for a plurality of luminance change rates, respectively. The first gamma offset may include a plurality of adjustment values (e.g., offsets or set values of control signals illustrated in FIG. 2C) for adjusting a plurality of the reference gamma voltages, respectively.

As described above with reference to FIG. 10, the method of compensating the luminance of the display panel 110 according to embodiments may measure the test luminances of the display panel 110 driven by the test data at the different time points while the MTP operation is performed, and may derive the luminance equation representing the luminance characteristic of the display panel 110 based on the test luminances. In particular, because the method measures the test luminances during the MTP operation is performed, an additional dedicated luminance measurement equipment (or installation of the luminance measurement equipment) and allocation of additional dedicated time for measuring the test luminances are not required, thereby preventing increase of a manufacturing time of the display panel 110.

Further, because the luminance equation of the display panel 110 derived from the test luminances of the display panel 110 accords with the actual luminance characteristic of the display panel 110, the method may accurately compensate for the luminance change (or the luminance drop) of the display panel 110.

In some embodiments, the method of compensating the luminance of the display panel according to embodiments may be applied to various display systems. For example, the method according to embodiments may be applied to a head mounted display (HMD), a television (TV), a computer monitor, a laptop computer, a digital camera, a cellular phone, a smart phone, a personal digital assistant (PDA), a portable multimedia player (PMP), a music player, a portable game console, a navigation device, a video phone, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims and their functional equivalents.

What is claimed is:

1. A method of compensating luminance of a display panel, the method comprising:

respectively measuring, at different time points, test luminances of the display panel driven by test data while a multi-time programming (MTP) operation for setting the luminance of the display panel respectively for one or more gray values is performed; and deriving a luminance equation representing a relationship between a driving time of the display panel and the luminance of the display panel based on the test data and the test luminances, wherein the luminance equation is represented by $Y=\alpha*X^2+\beta*X+\gamma$, wherein Y represents the luminance of the display panel, X represents the driving time of the display panel, and $\alpha$, $\beta$ and $\gamma$ are constants.

2. The method of claim 1, wherein the MTP operation comprises sub-MTP operations, wherein an N-th sub-MTP operation of the sub-MTP operations:

generates an N-th gamma voltage based on reference gamma voltages;

generates N-th gray data having an N-th gray value among the gray values used in the display panel;

provides the N-th gray data to the display panel;

measures an N-th actual luminance of the display panel driven by the N-th gray data; and adjusts the reference gamma voltages based on the N-th actual luminance and an N-th reference luminance that is set for the N-th gray value of the gray values, and wherein the reference gamma voltages respectively correspond to representative gray values among the gray values used in the display panel.

3. The method of claim 1, wherein the test data have a maximum one of the gray values used in the display panel.

4. The method of claim 3, wherein respectively measuring, at the different time points, the test luminances of the display panel comprises:

measuring a first test luminance of the display panel driven by the test data at a first time point;

measuring a second test luminance of the display panel driven by the test data at a second time point that is later than the first time point by a first time interval; and measuring a third test luminance of the display panel driven by the test data at a third time point that is later than the second time point by a second time interval.

5. The method of claim 4, wherein the first time interval and the second time interval have a same time length.

6. The method of claim 4, wherein the first time point is a time point at which the MTP operation starts, and wherein the third time point is a time point at which the MTP operation ends.

7. The method of claim 4, wherein the MTP operation comprises:

a first sub-MTP operation for at least one of first gray values that is less than or equal to a maximum gray value, and greater than or equal to a middle gray value, the first sub-MTP operation being performed during the first time interval between the first time point and the second time point; and a second sub-MTP operation for at least one of second gray values that is less than the middle gray value, and greater than or equal to a minimum gray value, the second sub-MTP operation being performed during the second time interval between the second time point and the third time point.

8. The method of claim 4, wherein measuring the first test luminance comprises:

generating a test voltage corresponding to the test data based on reference gamma voltages;

providing the test voltage to the display panel; and measuring the first test luminance of the display panel corresponding to the test voltage.

9. The method of claim 4, wherein the luminance equation is a cubic equation derived from the first test luminance at the first time point, the second test luminance at the second time point, and the third test luminance at the third time point.

10. The method of claim 1, further comprising compensating for a luminance change of the display panel based on the luminance equation.

11. The method of claim 10, wherein compensating for the luminance change of the display panel comprises:

calculating an actual driving time of the display panel;

when the actual driving time exceeds a first driving time, calculating a first luminance change rate corresponding to the first driving time using the luminance equation; and compensating for the luminance change of the display panel based on the first luminance change rate.

12. The method of claim 11, wherein the actual driving time is calculated by accumulating input data provided to a display device comprising the display panel.

13. The method of claim 11, wherein the first driving time is longer than a time required for a module test process performed before a manufacturing process of a display device is completed.

14. The method of claim 11, wherein compensating for the luminance change of the display panel based on the first luminance change rate comprises:

obtaining a first gamma offset corresponding to the first luminance change rate using a lookup table comprising a plurality of gamma offsets that are previously set for a plurality of luminance change rates, respectively; and adjusting reference gamma voltages based on the first gamma offset, wherein the first gamma offset comprises adjustment values respectively for the reference gamma voltages, and wherein the reference gamma voltages correspond to representative gray values among the gray values used in the display panel, and are used to generate gamma voltages respectively corresponding to the gray values used in the display panel.

15. A method of compensating luminance of a display panel, the method comprising:

measuring a first test luminance of the display panel driven by test data having a maximum gray value of gray values used in the display panel at a first time point;

performing a first sub-multi-time programming (MTP) operation on at least one of first ones of the gray values that is less than or equal to the maximum gray value;

measuring a second test luminance of the display panel driven by the test data at a second time point;

performing a second sub-MTP operation on at least one of second ones of the gray values that is less than the first ones of the gray values;

measuring a third test luminance of the display panel driven by the test data at a third time point; and deriving a luminance equation representing a relationship between a driving time of the display panel and the luminance of the display panel based on the test data, the first test luminance, the second test luminance, and the third test luminance, wherein the luminance equation is represented by $Y=\alpha*X^2+\beta*X+\gamma$, wherein Y represents the luminance of the display panel, X represents the driving time of the display panel, and $\alpha$, $\beta$ and $\gamma$ are constants.

16. The method of claim 15, wherein the second time point is later than the first time point by a first time interval, wherein the third time point is later than the second time point by a second time interval, and wherein the first time interval and the second time interval have a same time length.

17. The method of claim 15, wherein the first time point is a time point at which an MTP operation comprising the first and second sub-MTP operations starts, and wherein the third time point is a time point at which the MTP operation ends.

18. The method of claim 15, further comprising compensating for a luminance change of the display panel based on the luminance equation.

19. The method of claim 18, wherein compensating for the luminance change of the display panel comprises:

calculating a first luminance change rate corresponding to a first driving time of the display panel using the luminance equation;

obtaining a first gamma offset corresponding to the first luminance change rate using a lookup table comprising a plurality of gamma offsets that are previously set for a plurality of luminance change rates, respectively; and adjusting reference gamma voltages based on the first gamma offset, wherein the first gamma offset comprises adjustment values respectively for the reference gamma voltages, and wherein the reference gamma voltages correspond to representative gray values among the gray values used in the display panel, and the reference gamma voltages are used to generate gamma voltages respectively corresponding to the gray values used in the display panel.

* * * * *